US007552694B2

(12) United States Patent
Dingel et al.

(10) Patent No.: US 7,552,694 B2
(45) Date of Patent: Jun. 30, 2009

(54) FRAMELESS PONTOON BOAT

(75) Inventors: Bryan Dingel, Boise, ID (US); William Parks, Moscow, ID (US)

(73) Assignee: Northwest River Supplies, Inc., Moscow, ID (US)

( * ) Notice: Subject to any disclaimer, the term of this patent is extended or adjusted under 35 U.S.C. 154(b) by 0 days.

(21) Appl. No.: 12/176,932

(22) Filed: Jul. 21, 2008

(65) Prior Publication Data

US 2008/0276855 A1 Nov. 13, 2008

Related U.S. Application Data

(63) Continuation of application No. 11/300,150, filed on Dec. 13, 2005, now Pat. No. 7,530,321.

(51) Int. Cl.
*B63B 7/00* (2006.01)

(52) U.S. Cl. ..... 114/345; 441/40

(58) Field of Classification Search ..... 114/345; 441/40, 129, 130, 131, 132
See application file for complete search history.

(56) References Cited

U.S. PATENT DOCUMENTS

| | | | | |
|---|---|---|---|---|
| 12,143 | A | 1/1855 | Tucker | |
| 1,562,276 | A * | 11/1925 | Assenzio | 441/132 |
| 1,715,312 | A | 5/1929 | Steele | |
| 1,996,576 | A | 4/1935 | Hegewaldt | |
| 2,223,625 | A | 12/1940 | Krupp | |
| 139,176 | A | 10/1944 | Gaide | |
| 2,508,304 | A | 5/1950 | Sturtevant | |
| 2,743,510 | A * | 5/1956 | Mauney et al. | 114/345 |
| 2,747,204 | A | 5/1956 | Erickson et al. | |
| 2,803,839 | A | 8/1957 | Mosley | |
| 2,980,927 | A | 4/1961 | Waters, Sr. | |
| 3,432,868 | A | 3/1969 | Lowery | |
| 3,490,085 | A | 1/1970 | Lewis | |
| 3,769,647 | A | 11/1973 | Basa | |
| 3,931,655 | A | 1/1976 | Luscombe | |
| RE28,916 | E | 7/1976 | Rice et al. | |
| 4,251,893 | A | 2/1981 | McCrory et al. | |
| 4,462,331 | A | 7/1984 | McCrory | |
| 4,779,555 | A | 10/1988 | Hong | |
| 4,942,839 | A * | 7/1990 | Chuan | 114/345 |
| 4,973,278 | A | 11/1990 | Williams | |
| 5,171,178 | A | 12/1992 | Creek et al. | |
| 5,290,196 | A | 3/1994 | Steel | |
| 5,711,240 | A | 1/1998 | Baker | |
| 5,816,873 | A | 10/1998 | Pestel | |
| 5,868,095 | A | 2/1999 | Zeromski et al. | |
| 6,066,016 | A | 5/2000 | Yonover | |
| 6,155,899 | A | 12/2000 | Boddy | |
| 6,168,489 | B1 * | 1/2001 | Huston | 441/130 |

(Continued)

OTHER PUBLICATIONS

International Search Report for PCT/US06/47812.

*Primary Examiner*—Lars A Olson
(74) *Attorney, Agent, or Firm*—Zarian Midgley & Johnson PLLC

(57) ABSTRACT

A frameless inflatable pontoon boat in which the pontoons and connecting section have a generally flat top and a generally flat bottom. Sufficient rigidity is achieved in the inflatable connecting section and the pontoon by the use of internal thread connections between the top surface and the bottom surface. The internal thread connections confine the inflated shape of the pontoons and connecting section to a flat shape.

20 Claims, 2 Drawing Sheets

U.S. PATENT DOCUMENTS 6,209,476 B1 4/2001 Maurel et al.
6,250,983 B1 6/2001 Paterson
6,311,632 B1 11/2001 Noel, Jr.
6,318,287 B1 11/2001 Klimenko
6,343,560 B1 2/2002 Myers
6,491,558 B1 * 12/2002 Myers ..... 441/130
6,508,194 B2 1/2003 Myers
6,640,741 B1 11/2003 Myers
6,691,633 B1 2/2004 Metzger et al.
6,860,220 B2 3/2005 Flemining
2002/0073909 A1 6/2002 Liston et al.

* cited by examiner

FRAMELESS PONTOON BOAT

CROSS REFERENCE TO RELATED APPLICATION

This application is a continuation application of U.S. patent application Ser. No. 11/300,150, filed Dec. 13, 2005 now U.S. Pat. No. 7,530,321, the entire contents of which is hereby incorporated by reference in its entirety.

FIELD OF INVENTION

The invention relates generally to a pontoon boar, and more particularly to an inflatable pontoon boat without a rigid frame.

BACKGROUND OF THE INVENTION

A type of boat structure which has evolved in recent times is a type called a pontoon boat. In a pontoon boat there are typically two individual pontoons which are held in a spaced apart relationship by a metal frame. The metal frame also provides a place for mounting a seat for one or more users to sit on. The pontoon boat may be propelled by paddle wheels on each side, by a small motor, or by oars that work in oarlocks mounted on the frame. Pontoon boats have been used successfully in whitewater, and also in still water for purposes of fishing.

One feature that exists in all pontoon boats is the frame that provides rigidity to the boat, and which holds the pontoons in a rigid position, and which provides the structure on which a seat may be placed. This frame also presents a problem in the use of pontoon boats. The frame is large, and typically attached to the pontoons in a way that is cumbersome and time consuming to remove of disassemble. The size and weight of the frame make it hard to put on the top of a car, and make it impossible to fit inside of a car. Even if the pontoons are deflated, the pontoons are spaced far enough apart to provide stability in the water, and this spacing makes the pontoons and the frame too wide and too bulky to fit inside a car. Instead of fitting the pontoon boat inside a car or even a pickup, the user is forced to haul the pontoon boat in a trailer. Having to hook up a trailer to haul the pontoon boat deprives the user of a certain amount of flexibility in transportation, and makes the use of the pontoon boat more troublesome.

A pontoon boat without a frame would provide certain advantages. If the pontoon boat were fully deflatable and did not have a rigid frame holding it together, it could fit into a trunk of a car, a station wagon, or a small pick-up.

The challenge for the pontoon boat without a frame is that it would be held together by a non-rigid and inflatable member. An inflatable member for performing this task would have to provide sufficient rigidity that the user could sit on the connecting member and be supported, and the pontoons would be held in a spaced apart relationship without excessive flexing or movement. This is difficult to achieve in an inflatable structure because unless the structure is inflated to a very high pressure, it would not have sufficient rigidity to replace the frame. A structure inflated to a high pressure has other disadvantages such as it is hard to inflate the structure to that pressure, and if a leak develops, it would quickly lose that pressure and become a boat with very bad characteristics.

SUMMARY OF THE INVENTION

The boat of the invention is a frameless inflatable pontoon boat. It utilizes a left and a right pontoon, both of which are inflatable. Each of the pontoons has a top surface and a bottom surface. The left and right pontoons are connected to each other by a connecting section which is also an inflatable structure. The connecting section is considerably more rigid than typical hollow inflated structures. The connecting section has a top surface and a bottom surface and it has a generally non-circular cross section. The connecting section can be flat on either the bottom or top surface. The connecting section gains its rigidity by internal thread connections which connect the top surface and the bottom surface. The connecting section is attached to the left and right pontoon and holds them in a spaced apart relationship. The connecting section may be attached to the inner sides of the pontoons, or it may be attached to the top surface of each of the pontoons.

Another embodiment of the frameless inflatable pontoon boat of the invention includes a left and right pontoon in which the bottom surface of each is generally planar, and each has an internal structure which includes multiple internal connections between the top surface and the bottom surface of the pontoon. These internal connections provide rigidity to the pontoons when they are inflated to an adequate pressure. The internal thread connections also allow the shape of the pontoon or the connecting section to be something other than round in cross section. Thus, by the use of a structure with multiple internal connections between the top surface and the bottom surface, the pontoons or the connecting sections can be made to be generally flat on both the bottom and the top, and quite rigid. In this version of the pontoon boat, the connecting section attaches to the left and right pontoons approximately in the center of the pontoons, leaving the front of the pontoons extending forward and backward from the connecting section, and providing a pontoon boat held together only by the connecting section, without a frame or structure forming the bow of the boat. The pontoon boat includes a seat attached to the connecting section for a user to sit in when using the pontoon boat. By keeping the region between the pontoons in front of the seat open, the user of the pontoon boat can use flippers attached to his feet for guidance and propulsion, and can also clearly see the area of water in front of the boat.

The seat may strap to the connecting section, or may be attached by other conventional means such as by hook and loop attachments, by clips, by hooks and D-rings, by lacing, or by other conventional means of attachment. The seat may also be attached permanently into the structure of the connecting section.

An alternative embodiment of the connecting section is one in which the connecting section is generally H-shaped and generally planar in configuration on its top and bottom. The inflatable structure of the connecting section is kept planar by the use of the internal thread connections between the top surface and the bottom surface of the connecting section. In the H-shaped version of the connecting section, one side of the H is mounted over the top of one pontoon, and the other side of the H is mounted over the top of the other pontoon. The connecting bar of the H is the center of the connecting section on the boat which extends between the pontoons, holds them spaced apart and adds rigidity to the structure.

Another embodiment of the pontoon boat of the invention is one in which the pontoons have a generally planar top and bottom surface. This is in contrast to prior art pontoon boats which have cross sections of the pontoons which are generally rounded or circular. The rounded shape of the prior art pontoons comes from the pressure inside the pontoon pressing equally on all sides of the inflated structure, which presses the structure into a rounded shape. The planar shape of the pontoons of the invention is achieved by the internal thread connections between the top and bottom surface of the pontoons in the connecting section. The internal connections can be made of pieces of material or fabric which are attached between the top and bottom surfaces. The internal connections can also be thread-like strands of material which are attached to the top and bottom surface and which limit the inflated structure of the pontoons and the connecting section from being pressed into a round shape, and hold them in a flat configuration. The pontoons and connecting section utilized with this material is typically fully rigid when inflated to 5 pounds of pressure per square inch.

The pontoon boat of the invention can also include built-in oarlocks which are part of the connecting section and which allow a user to use oars for paddling.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention, which is measured by the claims, nor is it intended to be limiting as to the scope of the invention in any way.

Still other features and advantages of the present invention will become readily apparent to those skilled in this art from the following detailed description describing only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
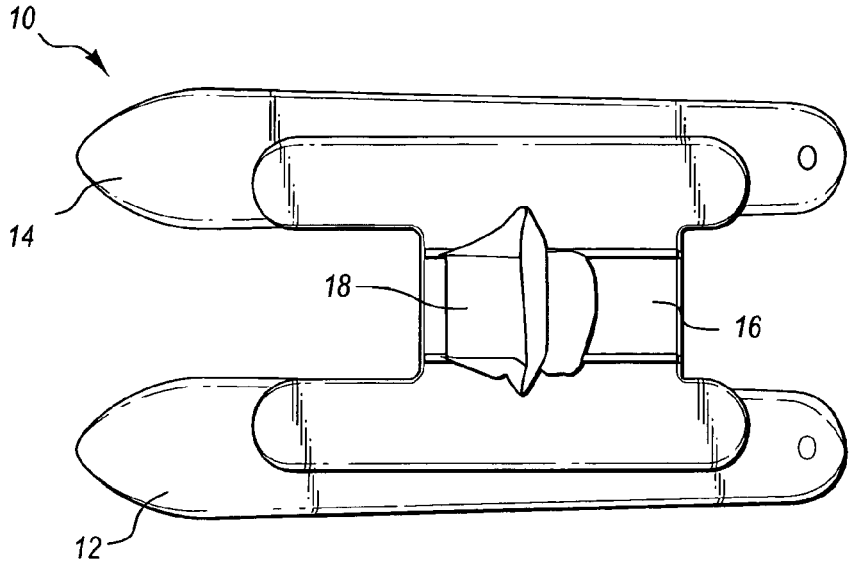
FIG. 1 is a plan view of the pontoon boat of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

FIGS. 1-4 show the pontoon boat of the invention. FIG. 1 shows the pontoon boat 10 of the invention with a left pontoon 12, right pontoon 14 and a connecting section 16. Attached to the connecting section 16 is a seat 18.

The dimensions of the pontoon and connecting section can vary according to the purpose the pontoon boat is intended for. For instance a whitewater boat would be different than a boat for flyfishing in still water. One size that has proven to be advantageous, but which is not meant to be limiting in the scope of the patent, is one in which the pontoons are approximately 96-120 inches long, 6-14 inches tall, and 10-16 inches wide. A range of about 5 feet to 10 feet is possible in pontoon length. In this particular configuration of the pontoon boat, the connecting section 16 is generally H-shaped, and is attached to the top surface of the pontoons. In this configuration, the connecting section is approximately the same width as the pontoon and about 10 inches shorter. The section which connects the two sides of the H is approximately 58 inches wide and 30-34 inches long.

An important characteristic of the pontoon boat 10 of the invention is that it does not utilize a rigid metallic frame as other pontoon boats do. It is entirely inflatable, and thus the entire boat can be deflated for convenient storage and transportation.

The connecting section achieves sufficient rigidity to replace the metal frame by the use of fabric which has internal thread connections between the top surface 20 and the bottom surface 22 of the connecting section. One way to achieve the internal thread connections required for enhanced rigidity is to use a fabric called Dropthread or Dropstitch. This material has a top and bottom surface which are connected by a large number of internal thread connections. The fabric of the top surface and bottom surface can utilize any number of different fabrics, and a preferable fabric for these surfaces for use in a pontoon boat is urethane coated nylon, hypolon, or other suitable materials. When a component made of the dropstitch fabric is inflated, the internal thread connections confine the expansion of the material to the desired shape. This can result in a flat surface which is inflatable and has a high rigidity. Material of this type is typically rigid at 4 pounds psi and is very rigid at 10 pounds psi. These are pressures which are obtainable by the hand operated pumps typically available to users of inflatable rafts and boats.

One configuration of the pontoon boat of the invention is one in which the connecting section 16 is made of dropthread fabric, but the pontoons are conventionally inflated pontoons. The connecting section in this embodiment of the pontoon boat can be H-shaped, and the connecting section can attach to the pontoons by various means such as straps, dips, zippers, lacing, pins or other conventional means of attaching one unit to another.

A preferred embodiment of the invention is one in which the connecting section 16 is made of dropthread fabric or another fabric which has similar characteristics, and in which the pontoons are also made of dropthread fabric. By the use of dropthread fabric, each of these structures can be made quite a bit thinner than a normal inflated structure. This has several advantages. In a conventional pontoon, the pontoons have a generally round cross-section. When weight is placed on a pontoon boat, the boat sinks into the water until the weight of the water that is displaced equals the weight of the boat, the equipment and the rider on the boat. In the case of a tubular pontoon, in order to displace an equal amount of water as the weight of the boat, quite a bit of the pontoon has to be above the water. This results in excess fabric being utilized in the pontoon and in the user of the pontoon being higher above the surface of the water. If a pontoon can be made to be relatively flat as it presses into the water, it displaces more water in the first few inches of insertion. Thus, sufficient water is displaced before the pontoon penetrates very deeply into the water. For that reason, the pontoon does not have to be very thick, thus saving weight and fabric, and placing the user in a lower position on the water. This is advantageous for helping the user row, paddle, or use flippers to propel the boat.

Figure 2:
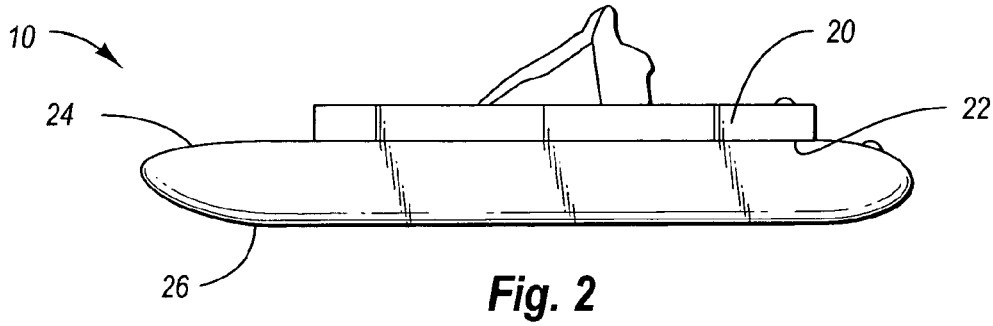
FIG. 2 is a side view of the pontoon boat of the invention.

FIG. 2 is a side view of a pontoon boat of the invention which shows the top surface 24 of the pontoons and the bottom surface 26 of the pontoons.

Figure 3:
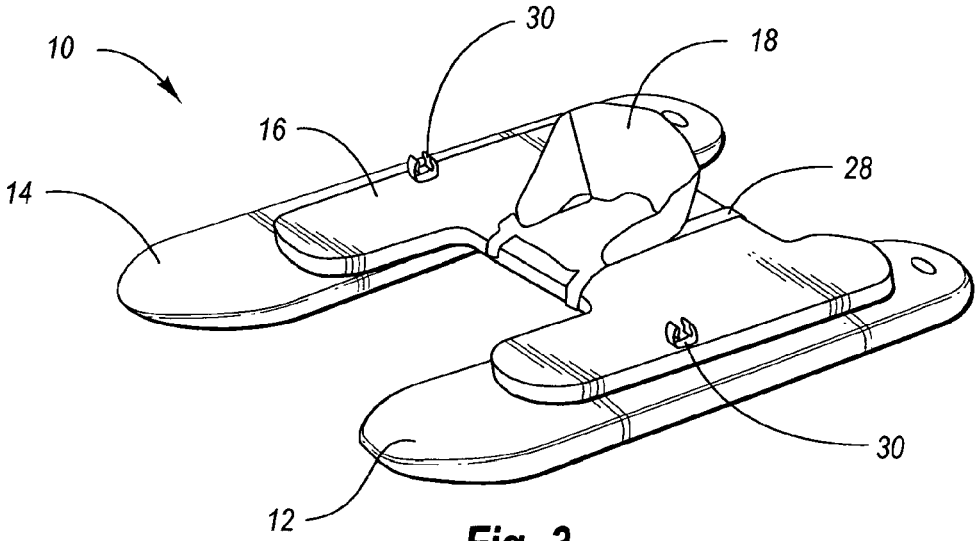
FIG. 3 is a perspective view of the pontoon boat of the invention.

FIG. 3 shows the seat 18 attached by straps 28. The seat could also be permanently built into the connecting section 16 or attached by other means. FIG. 3 also shows oarlocks 30 which are an optional feature which may be permanently or removably attached to the connecting section 16.

Figure 4:
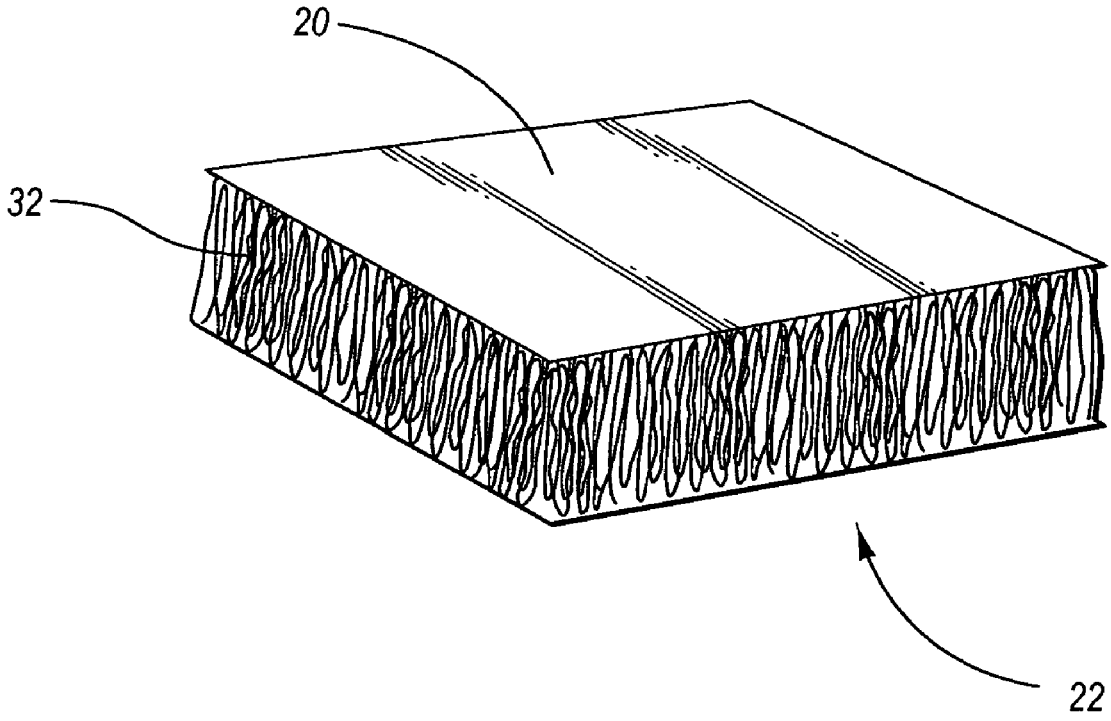
FIG. 4 is a perspective view of material forming planar sections of the pontoon boat.

FIG. 4 shows an example of a material which has a top surface 20 and a bottom surface 22 and includes internal thread connections 32, of which dropthread is one type.

The pontoon boat disclosed may be taken apart for easier carrying and storage. It can operate on shallower water because of its small draft of water. Since it has a lower profile, it is less subject to wind than other pontoon boats.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A frameless inflatable pontoon boat comprising:

an inflatable left pontoon having a top surface and a bottom surface;

an inflatable right pontoon having a top surface and a bottom surface; and an inflatable connecting section, having a top surface, a bottom surface, a right side, and a left side, the inflatable connecting section being generally planar and having an internal structure comprising multiple internal thread connections, wherein the left side of the inflatable connecting section is configured to connect to the top surface of the left pontoon with straps, dips, zippers, lacing, or pins, wherein the right side of the inflatable connecting section is configured to connect to the top surface of the right pontoon with straps, dips, zippers, lacing, or pins, and wherein the inflatable connecting section of the frameless inflatable pontoon boat is configured to be fully rigid when inflated to 5 pounds of pressure per square inch.

2. The frameless inflatable pontoon boat of claim 1 in which the pontoons are generally planar and have an internal structure comprising multiple internal thread connections.

3. The frameless inflatable pontoon boat of claim 1 in which the boat further comprises a seat connected to the inflatable connecting section with straps, hook and loop attachments, clips, hooks and D-rings, or lacing.

4. The frameless inflatable pontoon boat of claim 1 in which an area between the pontoons and in front of the inflatable connecting section is open, with no connecting structure or bow.

5. The frameless inflatable pontoon boat of claim 1 in which the pontoons extend from the inflatable connecting section in both a fore and aft direction.

6. The frameless inflatable pontoon boat of claim 1 in which the pontoons are configured to be fully rigid when inflated to 5 pounds of pressure per square inch.

7. The frameless inflatable pontoon boat of claim 1 in which the pontoon boat further comprises connected oarlocks.

8. A frameless inflatable pontoon boat comprising:

an inflatable left pontoon, having a generally planar top and bottom surface and a generally rectangular cross-section, with an internal structure comprising multiple internal connections;

an inflatable right pontoon, having a generally planar top and bottom surface and a generally rectangular cross-section, with an internal structure comprising multiple internal connections;

an inflatable connecting section, having a generally planar top and bottom surface, a right and left side, with an internal structure comprising multiple internal thread connections connecting the top and bottom surfaces, the left side of the inflatable connecting section connecting to the left pontoon, the right side of the inflatable connecting section connecting to the right pontoon; and a seat configured to connect to the inflatable connecting section with straps, hook and loop attachments, clips, hooks and D-rings, or lacing.

9. The frameless inflatable pontoon boat of claim 8 in which the pontoon boat further comprises connected oarlocks.

10. The frameless inflatable pontoon boat of claim 8 in which the inflatable connecting section is connected to the pontoons with straps, dips, zippers, lacing, or pins.

11. The frameless inflatable pontoon boat of claim 8 in which an area between the pontoons and in front of the inflatable connecting section is open, with no connecting structure or bow.

12. The frameless inflatable pontoon boat of claim 8 in which the pontoons extend from the inflatable connecting section in both a fore and aft direction.

13. The frameless inflatable pontoon boat of claim 8 in which the inflatable connecting section and pontoons are fully rigid when inflated to 5 pounds of pressure per square inch.

14. A frameless inflatable pontoon boat comprising:

an inflatable left pontoon having a top surface and a bottom surface;

an inflatable right pontoon having a top surface and a bottom surface; and an inflatable connecting section, having a top surface, a bottom surface, a right side, and a left side, the inflatable connecting section being generally planar and having a generally rectangular cross-section and an internal structure comprising multiple internal thread connections, wherein the left side of the inflatable connecting section is configured to connect to the top surface of the left pontoon with straps, dips, zippers, lacing, or pins, wherein the right side of the inflatable connecting section is configured to connect to the top surface of the right pontoon with straps, dips, zippers, lacing, or pins, and wherein the frameless inflatable pontoon boat is configured such that, when deflated, the entire frameless inflatable pontoon boat can fit within the trunk of a car.

15. The frameless inflatable pontoon boat of claim 14 in which the pontoons are generally planar and have a generally rectangular cross-section and an internal structure comprising multiple internal thread connections.

16. The frameless inflatable pontoon boat of claim 14 in which the boat further comprises a seat connected to the inflatable connecting section with straps, hook and loop attachments, clips, hooks and D-rings, or lacing.

17. The frameless inflatable pontoon boat of claim 14 in which the pontoon boat further comprises connected oarlocks.

18. The frameless inflatable pontoon boat of claim 14 in which an area between the pontoons and in front of the inflatable connecting section is open, with no connecting structure or bow.

19. The frameless inflatable pontoon boat of claim 14 in which the pontoons extend from the inflatable connecting section in both a fore and aft direction.

20. The frameless inflatable pontoon boat of claim 14 in which the pontoons are configured to be fully rigid when inflated to 5 pounds of pressure per square inch.

* * * * *